US006799683B2

(12) United States Patent
Jounela et al.

(10) Patent No.: US 6,799,683 B2
(45) Date of Patent: Oct. 5, 2004

(54) FLOTATION MECHANISM AND METHOD FOR DISPERSING GAS AND CONTROLLING FLOW IN A FLOTATION CELL

(75) Inventors: Seppo Jounela, Espoo (FI); Launo Lilja, Pori (FI); Bror Nyman, Pori (FI)

(73) Assignee: Outokumpu Oyj, Espoo (FI)

( * ) Notice: Subject to any disclaimer, the term of this patent is extended or adjusted under 35 U.S.C. 154(b) by 1 day.

(21) Appl. No.: 10/332,435

(22) PCT Filed: Jul. 19, 2001

(86) PCT No.: PCT/FI01/00677

§ 371 (c)(1),
(2), (4) Date: Jan. 8, 2003

(87) PCT Pub. No.: WO02/07890

PCT Pub. Date: Jan. 31, 2002

(65) Prior Publication Data

US 2003/0173262 A1 Sep. 18, 2003

(30) Foreign Application Priority Data

Jul. 21, 2000 (FI) ..... 20001697

(51) Int. Cl.[7] ..... B03D 1/16; B01F 3/04
(52) U.S. Cl. ..... 209/169; 261/87
(58) Field of Search ..... 209/169, 164; 261/87

(56) References Cited

U.S. PATENT DOCUMENTS

| | | | | |
|---|---|---|---|---|
| 3,953,151 | A | | 4/1976 | Aryus et al. |
| 4,548,765 | A | * | 10/1985 | Hultholm et al. |
| 5,078,505 | A | * | 1/1992 | Nyman et al. |
| 5,219,467 | A | * | 6/1993 | Nyman et al. |
| 5,240,327 | A | * | 8/1993 | Nyman et al. |

FOREIGN PATENT DOCUMENTS

| | | |
|---|---|---|
| DE | 2029 340 C | 4/1971 |
| EP | 0 287 251 A2 | 10/1988 |

* cited by examiner

*Primary Examiner*—Thomas M. Lithgow
(74) *Attorney, Agent, or Firm*—Morgan & Finnegan, LLP

(57) ABSTRACT

The invention relates to a flotation mechanism (4) comprising a directional element (25) and vertical vanes (26) located in a flotation cell (2). The directional element is symmetrical and is fixed at the center to the lower section of the hollow shaft of the mechanism. According to the corresponding method, due to the directional element (25), which is cylindrically inclined downwards from the outer edge the flotation mechanism directs the gas-slurry suspension that is formed in a downward slanting direction towards the side wall of the cell. The mineral suspension rises upwards from the side wall towards the center of the cell, from where the flow is diverted to the edges of the cell and the froth generated is removed from the cell. Using this flotation mechanism enables a powerful agitation, extending throughout the entire mixing zone (I).

13 Claims, 4 Drawing Sheets

FLOTATION MECHANISM AND METHOD FOR DISPERSING GAS AND CONTROLLING FLOW IN A FLOTATION CELL

The present invention relates to a flotation mechanism comprising a directional element and vertical vanes located in a flotation cell. The directional element is symmetrical and is fixed at the centre to the lower section of the hollow shaft of the mechanism. According to the corresponding method, due to the directional element, which is cylindrically inclined outwards from the outer edge the flotation mechanism directs the gas-slurry suspension that is formed in a downward slanting direction towards the side wall of the cell. The mineral suspension rises upward from the sidewall towards the centre of the cell, from where the flow is diverted to the edges of the cell and the froth generated is removed from the cell. Using this flotation mechanism enables a powerful agitation, extending throughout the entire mixing zone of the flotation cell.

Flotation cells may be single mixing vessels, in series or in parallel. They may be either rectangular or cylindrical in shape, in horizontal or upright position. Gas is routed through the hollow mixing shaft to the small rotating rotor on the bottom. The rotor causes a powerful suction as it rotates, which sucks the gas into the rotor space. In the rotor space the slurry is mixed with the gas bubbles discharging and dispersing via the shaft. Usually a stator built of vertical plates is installed around the rotor, which promotes gas dispersion and attenuates the rotation of the slurry. Mineral particles stuck to the gas bubbles rise from the stator to the surface of the froth layer and from there out of the cell into the froth launders.

Nowadays it is becoming increasingly common to use upright cells, which are also cylindrical and normally flat-bottomed. One problem with flotation cells is sanding, i.e. solid matter builds up on the bottom of the cell in an immovable layer. This is usually due to a too small or ineffective rotor, as in such a case the mixing zone of the rotor does not extend far enough. Another common difficulty is that the mineral particles already attached to the gas bubbles cannot be removed from the flotation cell, because the flows forming in the cell and particularly at its surface and upper section are wrongly oriented or too weak i.e. they are not able to move the flotated gas bubbles out of the cell.

A flotation mechanism is known in the prior art according to U.S. Pat. No. 4,078,026, where the gas to be dispersed is conveyed via a hollow shaft to the inside of a rotor rotating on said shaft. The rotor is designed in such a way as to preserve a balance between the hydrostatic and dynamic pressure, that is, the vertical section of the rotor is a downward narrowing tapered cone. The rotor has separate slurry slots for slurry and gas.

Figure 3:
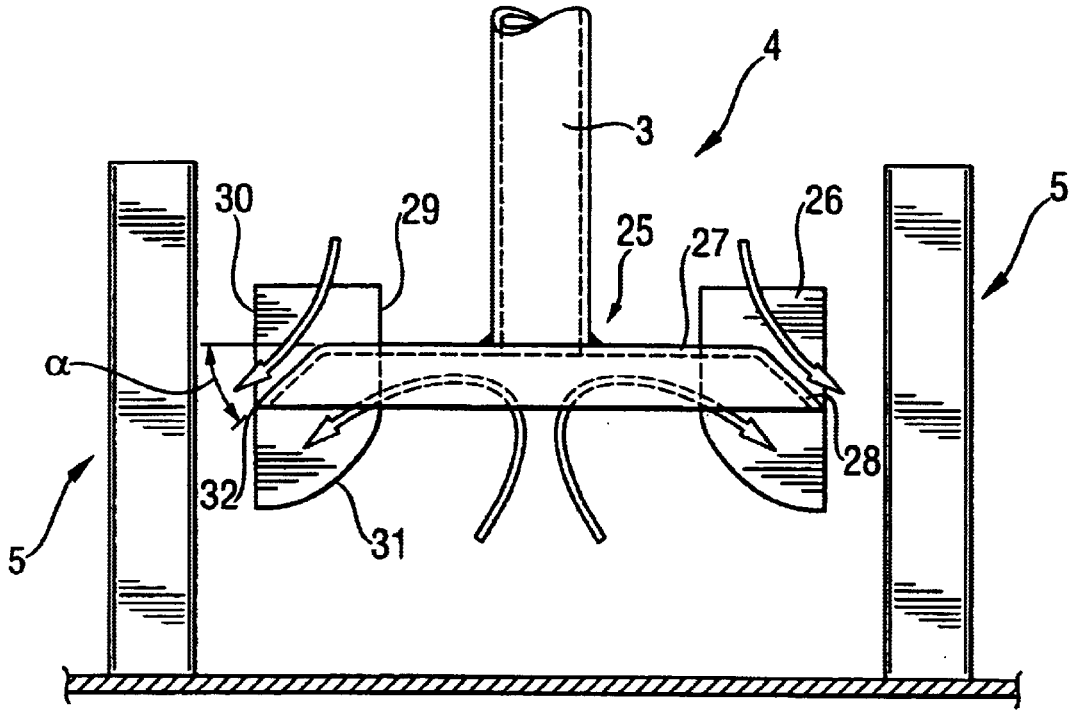

The so called Svedala mechanism known before by EP patent 844 911 deals with a mixer fixed to an upright shaft for mixing gas and slurry. In this mixer there are several vertical plates radially around the shaft and between the plates there is a horizontal baffle around the shaft, with a width of about half that of each plate. Gas enters below the baffle. The parts of the mixer above the baffle cause first a downward flow, which then at the baffle becomes an outward flow and correspondingly the parts below the baffle cause first an upward and then outward flow, as shown in FIG. 3 of the patent. The outer edges of the blades of the mixer are straight at their upper part, but the lower parts narrow inwards in a concave fashion. There is a stator around the mixer.

U.S. Pat. No. 5,240,327 describes a method of mixing different phases particularly in a conditioning cell. In connection with the method, there is described the zones creating in the reactor and a controlled flow dynamic in order to achieve zone distribution. The patent describes a cylindrical, flat-bottomed upright reactor, wherein are vertical baffles in order to attenuate the turbulence of the slurry. In addition the reactor has a ring-shaped horizontal baffle (back-flow guiding member) in order to guide the vertical flows and divide the reaction space in two. The patent further describes a special mixer with which to obtain the desired flow dynamics. This arrangement thus enables the formation of a double toroid in the section below the horizontal guiding member thanks to the combined effect of the horizontal guiding member and the mixer, wherein the slurry fed into the lower section first swirls in the lower bottom toroid and then gradually shifts to the upper toroid. From here the well-mixed dispersion rises into the pacified and controlled flow zone situated above the guiding member and is then removed via an overflow aperture. The double zone model described in the patent is suitable for normal chemical reactions and particularly for the flotation and conditioning of mineral concentrates.

A mineral slurry conditioning cell is known from U.S. Pat. No. 5,219,467, which is in some way a further development of the method and equipment mentioned in the previous patent. The apparatus comprises a colon-like reactor, in which concentration takes place in three separate zones. The reactor is equipped with upright flow guides, a horizontal flow attenuator and a mixer. Flotation reactions are created in the bottom zone, from where gas bubbles and mineral particles carried by them are directed to the surface of the apparatus. The apparatus is designed so that a strong agitation can be used in the bottom zone without harming the separation of the froth in the upper zone.

Now a new flotation mechanism has been developed, which achieves a powerful agitation in the coverage area of the mixer, which extends throughout the whole lower zone or mixing zone. The mechanism or mixer disperses the flotation gas into fine "milky" bubbles. It is advantageous to feed the gas via the shaft of the mixer. The mixer sucks the slurry both up and down and mixes it effectively into the bubbles of gas being generated.

Thanks to its guiding element, which is cylindrically inclined from the outer edge, the mixer directs the gas-slurry-solid suspension formed at a downward angle towards the inner wall of the cell. The flotation mechanism according to this invention fulfils for instance the requirements presented for the latter described mechanism. Furthermore, the mixer is not only effective but also its structure is balanced, strong and above all simple.

The flotation mechanism of this invention can be called glsdl (gas-liquid-solid-dispersion-lap). The purpose of the apparatus according to this invention is to disperse the flotation gas into small, fine bubbles that are evenly distributed in the slurry, to develop a strong turbulence in the immediate range of the mixer i.e. agitation intensity, and to prevent in this way coarse particles from settling on the bottom of the flotation cell. Another purpose is to create the kind of flow in the flotation cell described in the previously-mentioned patent, in other words, to generate a toroidal flow in the mixing zone directed down from the mixer to the side walls, and correspondingly above the mixer a toroidal flow directed upwards from the mixer to the side walls. The agitation intensity is several kilowatts per cubic meter of slurry. Using the cell constructions of the prior art (vertical and horizontal guiding elements), a part of the toroidal flow is routed via the pacified zone to the upper zone, from where the mineral particles with the gas bubbles rise to the froth layer, and from there to the froth launders around the cells.

According to this invention the flotation mechanism consists of two parts: the directional element and the upright vanes. The directional element is symmetrical and is fixed at the centre to the lower section of the hollow shaft of the mechanism. The central section of the directional element, i.e. the part directed outward from the shaft is a horizontal circular plate, which is folded downwards at its outer edge in the shape of a truncated cone. The downward folded outer edge forms an angle $\alpha$ with the horizontal plane, preferably between 30–60°, and this directional element lap forms the actual guiding element. Vertical vanes are fixed to the directional element, numbering at least four, but preferably six. These vertical vanes extend above and below the directional element and sideways preferably right up to the outermost edge of the directional element. The width of the vertical vanes is advantageously greater than that of the conical lap of the directional element and thus the inner edge of the vanes extends as far as the horizontal plate. It is also preferable to place a horizontal guiding plate on the inside of the directional element, to direct the gas discharging via the shaft to the side towards the directional element lap. The essential features of the invention will become apparent in the attached claims.

The outer edge of the flotation mechanism vanes is substantially vertical, whereby the most effective dispersion of flotation gas is achieved, i.e. the maximum underpressure is generated behind the vane. The inner edge of the vane is vertical at the top, but narrowing in a curve at the bottom designed this way with the purpose of minimising energy loss. The curve preferably follows the shape of a circular arc, where the centre point of the circle is the outer edge of the vane. The advantage of a downwardly narrowing vane is also the fact that the mechanism is easy to restart after a stop, regardless of the settling slurry around it.

The mixing/flotation mechanism of this invention works even without stators, but as has been found in flotation, this mechanism also functions more effectively when using stators around it. The stator is in such a case a conventional one i.e. it comprises upright, rectangular-shaped plates. The stator attenuates the turbulence and also the flow of the slurry to some degree, but nevertheless it does not "spoil" the basic idea of the mechanism. The positive impact of the stator is that it balances out the distribution of energy in the mixing zone.

The invention is described further by means of the attached drawings, where

Figure 1:
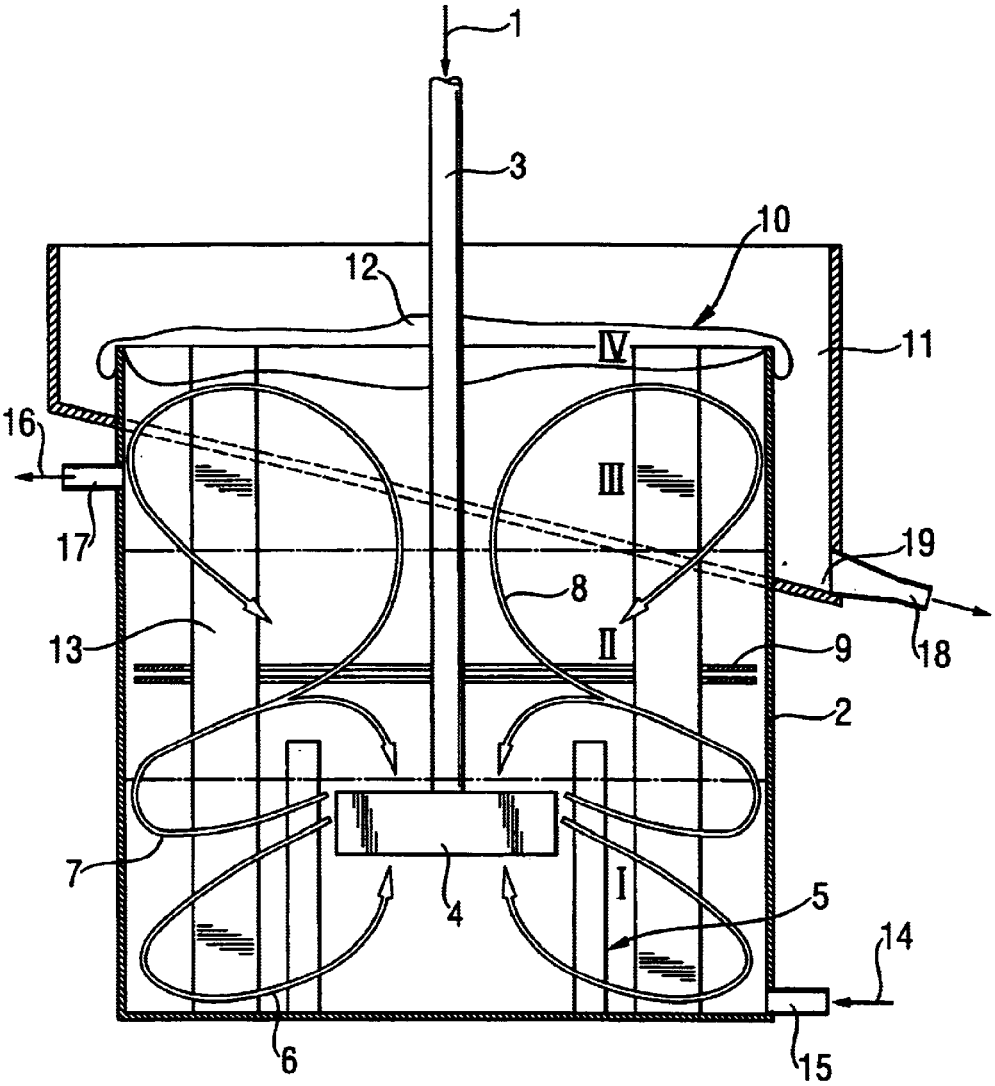
Figure 2:
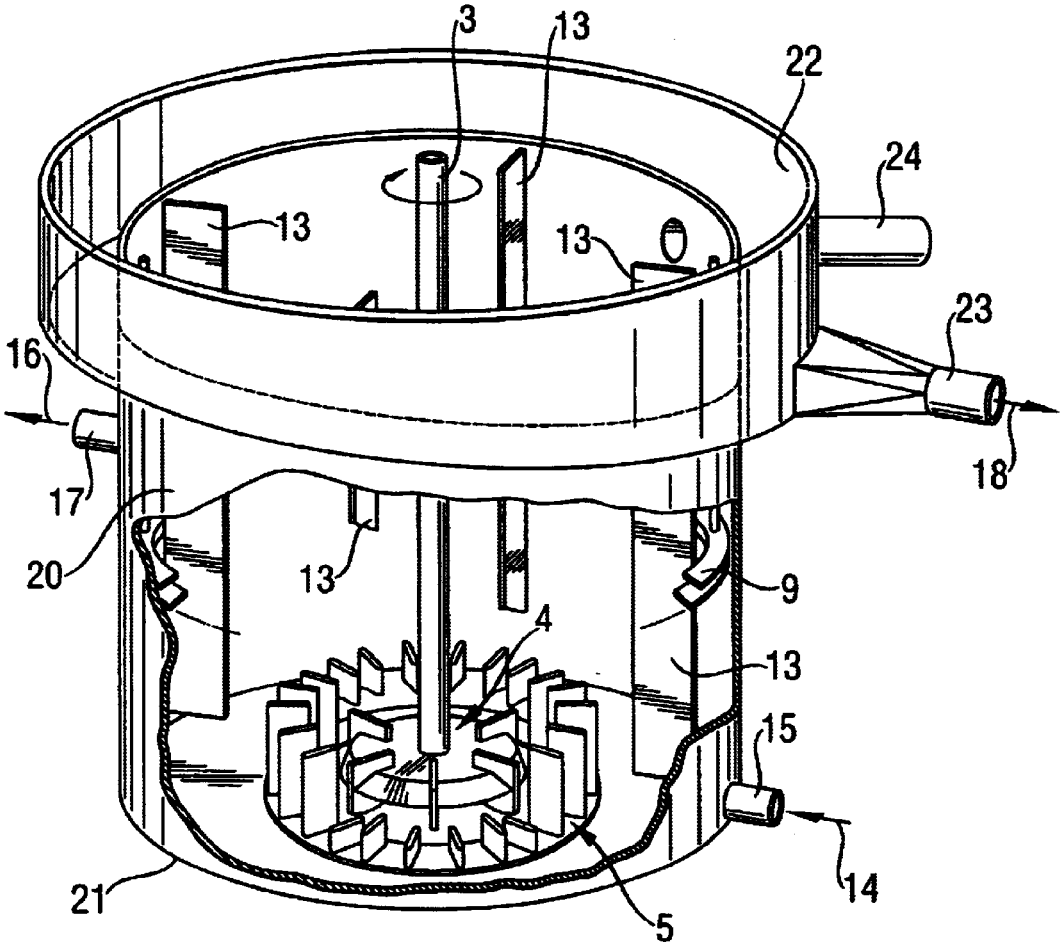
Figure 4:
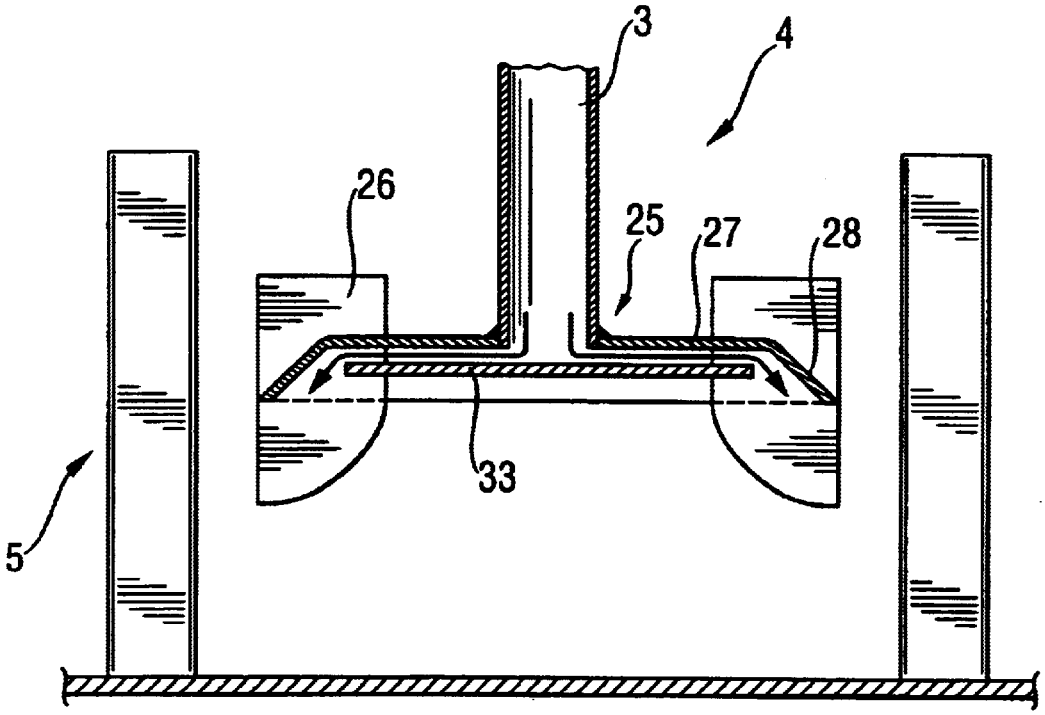

FIG. 1 is a diagram of the flow aspired to and achieved with the mixer of the invention, complete with the fourth zone, the froth layer, FIG. 2 is an oblique axonometric illustration of an embodiment of the flotation cell according to the invention seen in partial cross-section, FIG. 3 is a vertical section of the mixing mechanism of the invention, and FIG. 4 presents a vertical section of an embodiment of the mixing mechanism of the invention, which is equipped with a directional element with inner guiding plate.

In FIG. 1 the different zones in the flotation cell are marked with Roman numerals, where zone I is the mixing zone with great energy density,
zone II is the concentration zone of the upward flow,
zone III is the discharge and attenuation zone of the upward flow, and
zone IV is the froth zone.

Gas 1 is fed through the hollow shaft 3 into the substantially upright cylindrical flotation cell 2 to the flotation mechanism 4 of the invention, situated in the lower section of the cell. When the mixer rotates at the bottom end of said shaft, it causes an effective dispersion of the gas into small bubbles, which are mixed into the slurry suspension flowing both upward and downward outside the mixer. Due to the effective directional impact of the mixer this gas-liquid-solid suspension is guided via the stator 5 surrounding the mixer towards the sidewalls of the cell. The stator usually comprises rectangular vertical plates. The powerfulness of the mixer of the invention and concentration in just mixing zone I is a prerequisite for the effective dispersion of gas and mixing of slurry and gas. In addition, the high power of the mixer in the mixing zone is also a precondition for the reactions related to flotation, in particular for the kinetics of the reactions.

Near the wall of the cell the flow divides into two toroidal flows; of which the lower eddy 6 flows around near the bottom of the cell as it returns to the centre below the mixer and the other correspondingly flows around and above the mixer as the upper eddy 7.

Part of the upper eddy 7 branches upward to rise as a partial flow 8 in the concentration zone II. This is achieved not only by the powerful directional effect of the mixer, but also with the help of a horizontal or several horizontal-guiding elements 9. In concentration zone II the whole of the upward suspension flow containing mineral particles attached to the gas bubbles is collected and concentrated at the central shaft of the cell. This method ensures that the remaining flow energy is utilised so that an adequate flow is generated in the discharge and attenuation zone III from the centre of the cell outwards, that the direction is also maintained in flow layer 10, i.e. zone IV. The attenuation zone, where the energy of the flow is pacified, is also necessary so that specifically the concentrate rising with the bubbles is transferred to the froth layer, rather than some other slurry stirred up by the powerful agitation. The mineral particles that have risen to the froth layer move to the collection launder 11 around the cell. The effectiveness of the froth transfer and the correct orientation of the mixing are seen as the elevation 12 of the froth layer near the shaft.

The horizontal circulation of the slurry is attenuated with laminar vertical guiding elements or vertical baffles 13, of which there are at least 4, but preferably 8. In addition, the baffles are preferably wider than normal and extend more to the centre of the cell. The ore slurry 14 to be processed is fed via the feed unit 15 in the lower section of the cell into the range of the mixer. Waste 16 is removed from zone III via outlet 17. Froth 18 is removed from the bottom 19 of the launder. It should be noted that it is important to keep mineral particles in the flow all the time once they have been flotated and to discharge them from the cell into the launder. This is possible precisely because of the flow dynamics control described above and because there are no obstacles in the upper part of the cell i.e. no solid elements to break the bubbles and weaken their carrying capacity.

FIG. 2 illustrates an embodiment of a flotation cell 20, which is upright, cylindrical with a flat bottom or slightly rounded at the lower edge 21. The drawing shows the froth launder 22 and its discharge outlet 23. The waste outlet pipe 24, horizontal guiding elements 9 and vertical flow baffles 13 are also shown. The flotation mechanism 4 of the invention is located at the lower part of the cell on the hollow shaft 3. The mixing mechanism is surrounded by a stator 5.

FIG. 3 is a cross-section of the flotation mechanism 4 of the invention attached to the hollow shaft 3, which operates as the gas feed device. The drawing includes the stator 5, made up of rectangular-shaped vertical plates, even though use of said stator is not obligatory in embodiments of the invention. The flotation mechanism 4 comprises two sections: a directional element 25 and vertical vanes 26. The directional element 25 is symmetrical and attached at the centre to the lower part of the hollow shaft 4 of the mechanism. The central section of the directional element i.e. the part oriented outward from the shaft is a horizontal circular plate 27, which is inclined downwards at its outer edge in the shape of a truncated cone. The downward inclined outer edge forms angle $\alpha$ with the horizontal, preferably between 30–60°, and this lap 28 of the directional element forms the actual guiding part. The diameter of the directional element lap (28) is ½–⅙ of that of the whole directional element.

Attached radially to the directional element 25 are upright vanes 26, numbering a minimum of four, preferably six. The upright vanes extend in the vertical direction above and below the directional element and laterally preferably right up to the outermost edge of the directional element. The width of the upright vanes is advantageously greater than that of the conical lap 28 of the directional element and thus the inner edge 29 of the upright vanes extends as far as the horizontal plate. The outer edge 30 of the vanes is basically vertical, enabling the most effective dispersion of flotation gas, i.e. the maximum underpressure is generated behind the vanes. The inner edge 29 of the vane is vertical at the top, but narrowing in an outward curve at the bottom 31 and designed this way with the purpose of minimising energy loss. The curve preferably follows the shape of a circular arc, where the centre point 32 of the circle is on the outer edge of the vane, preferably the intersection 32 of the outside edge of the directional element lap 28 and the vertical vane 30.

When the gas is sucked down along the hollow shaft and directed under the central plate 27 of the directional element, the gas is mixed with the flow of slurry entering the free space below the mixer and rising toward it. The mixed gas-slurry flow turns parallel with the circular plate 27, spreading outwards. Due to the effect of the downward inclined outer lap 28 of the directional element the flow is further deflected in a downward slope as desired. Thanks to the strong underpressure created behind the upright vanes 26 of the mixer, the gas is dispersed into small bubbles. The vanes form a smooth, narrow flow field below the mixer to the flow coming from below. Said flow and the gas dispersed in it is joined by a flow of slurry coming from above the mixer, which is also deflected in the same downward sloping direction because of the directional element lap 28. Thus directed, the whole combined suspension flows between the plates of the stator 5, which at the same time begin to attenuate and guide the flow radially in a horizontal direction away from the mixer to a group of jets.

FIG. 4 shows a flotation mechanism similar to that in FIG. 3, apart from a gas guiding plate 33 additionally placed on the inside of the directional element lap 28, which is used to divert the direction of the gas to an basically horizontal one before it is dispersed into the mineral slurry. As the amount of gas increases and/or the gas speed increases, from time to time pressure pulses are generated. The guiding plate helps to avoid these pulses. The diameter of the guiding plate is at maximum the same as that of the circular plate 27 and at minimum the size of the gas inlet i.e. the inner diameter of the shaft 3. The distance of the guiding plate from the circular plate is preferably between ½–⅙ of the diameter of the gas inlet.

The invention is illustrated further by the following examples.

EXAMPLE 1

A comparative study was made of three different mixers mixer a—an OK rotor (a normal flotation mechanism as in U.S. Pat. No. 4,078,026, mixer b—a gls mixer according to U.S. Pat. No. 4,548,765 and mixer c—a glsdl mixer according to the present invention.

Table 1 presents the comparative values measured for both shaft power and vertical force i.e. with what force the mixing mechanism affects the cell; a positive sign (+) indicates that mixing adds to the load affecting the bottom of the vessel and a negative sign (−) means that it lessens the loading effect. The gls mixer (b) was chosen as reference mixer. Both a and c mixers were run with and without a stator in a cell like that shown in FIG. 2. The gls mixer was used without a stator.

TABLE 1

Relative values of test results.

| | Relative shaft power | | Relative vertical force | |
|---|---|---|---|---|
| Mixer | No stator | with stator | No stator | with stator |
| a = OK rotor | 0.89 | 1.41 | −1.35 | −0.72 |
| b = gls | 1 | — | 1 | — |
| c = glsdl | 2.08 | 1.79 | −0.80 | −1.59 |

Mixer a, that is the OK mixer, uses the least power without a stator, but with a stator the shaft power was 1.6 times greater. At the same time the lessening vertical force on the cell fell when using a stator. This means that the a-mixer loses its energy in the stator blades due to the increasing resistance (increase of power), whereby less energy than previously is left for the upflow (decrease of vertical force). This was in fact proved by monitoring the cell flows, i.e. the effect of the flow concentrator, the horizontal ring, was to make matters worse than before. The flow from the mixer was too weak to overcome the buoyancy of the bubbles, whereby the flow in the cell occurred in both cases up from the sides of the cell and down from the centre i.e. impractical auxiliary controls were required to remove the froth, which tended to break the bubbles.

Mixer b or gls functioned as stated in the patent mentioned above, but the upward flow occurring in the centre was also too widely stretched i.e. weak in strength, so that in cells of a certain shape a beneficial central flow is not achieved either, since once again the buoyancy of the bubbles started to overcome the impulse strength of the slurry flow. The vertical force in this case is downward due to the construction of the mixer.

The glsdl mixer (c) according to the invention functions under all conditions in the desired manner, from the centre up to the surface and transferring the froth to the launder around the cell. This is shown in both the shaft power and the vertical forces. First of all the shaft power is greater in every case than with the reference mixers. Secondly, the shaft power decreases after installing a stator (by 0.86), which means that the stator does not create extra resistance, but in fact reduces it, since it levels out and guides the flow discharging from the mixer. Thus the desired direction is further intensified and extra energy is gained in zone II, the concentration zone of the upflow. Thirdly, this extra energy or increase uplift is seen in the vertical forces. The buoyancy effect is doubled.

During research three shapes of vertical cell were compared; the widening upper section structure of U.S. Pat. No.

5,219,467, the straight cylindrical structure of U.S. Pat. No. 5,078,505 and finally a structure constricting at its upper end like a bottle. The flow required in FIG. 1 was made more difficult the smaller the upper section was made, i.e. the only way to achieve the desired flow was with a mixer according to this invention. The reason for this is quite natural; a very strong and controlled upflow is needed in the centre in order to overcome the buoyancy of the bubbles and this does not exist in any other structure apart from the embodiment of our invention. A constriction at the top end of the cell means in this instance that the return flow no longer has enough space to sink down from the edges, in the case of a weak and labile flow.

What is claimed is:

1. A flotation mechanism for use in a flotation cell, the flotation mechanism being comprised of a directional element suspended from the bottom end of a hollow shaft which extends into the lower section of the cell, and upright vanes attached inwards from the substantially outer edge, extending above and below the directional element, and an substantially horizontal circular plate of the directional element being attached at the center symmetrically around the shaft and that the outer edge of the central plate is inclined downwards to form a guiding lap.

2. A flotation mechanism according to claim 1, wherein the downward inclined lap of the directional element forms a 30–60° angle with the horizontal.

3. A flotation mechanism according to claim 1, wherein the diameter of the directional element lap is ½–⅙ times that of the whole directional element.

4. A flotation mechanism according to claim 1, wherein the width of the upright vanes is greater than that of the directional element lap.

5. A flotation mechanism according to claim 1, wherein the upright vanes are attached radially to the directional element.

6. A flotation mechanism according to claim 1, wherein an outer edge of the upright vanes is vertical and an inner edge is vertical at the top and narrowing in an outward curve at the bottom.

7. A flotation mechanism according to claim 6, wherein the curve of the bottom of the inner edge of the upright vane follows the shape of a circular arc, where the center point of the circle is on the outer edge of the vane.

8. A flotation mechanism according to claim 1, wherein a gas guiding plate is placed on the inside of the directional element lap.

9. A flotation mechanism according to claim 8, wherein the diameter of the gas guiding plate is between that of the circular plate and that of the mixing mechanism shaft.

10. A flotation mechanism according to claim 8, wherein the is distance of the guiding plate from the circular plate is between ½–⅙ times the diameter of the mixing mechanism shaft.

11. A flotation mechanism according to claim 1, wherein the flotation mechanism is located in a flotation cell, which is equipped with vertical and horizontal flow guiding elements.

12. A flotation mechanism according to claim 1, wherein a stator is placed in the flotation cell around the flotation mechanism.

13. A flotation mechanism according to claim 1, wherein the hollow shaft of the flotation mechanism acts as a gas feed device.

* * * * *